US007624478B2

(12) United States Patent
Liu et al.

(10) Patent No.: US 7,624,478 B2
(45) Date of Patent: Dec. 1, 2009

(54) COTTON STALK BARK FIBER AND METHOD FOR PROCESSING COTTON STALK BARK

(76) Inventors: Lei Liu, B1001, Junyinxuan, Junjing Garden, #190 Zhongshan Avenue, Guangzhou (CN) 510000; Shiyong Jin, B1001, Junyinxuan, Junjing Garden, #190 Zhongshan Avenue, Guangzhou (CN) 510000

( * ) Notice: Subject to any disclaimer, the term of this patent is extended or adjusted under 35 U.S.C. 154(b) by 108 days.

(21) Appl. No.: 12/252,402

(22) Filed: Oct. 16, 2008

(65) Prior Publication Data

US 2009/0038122 A1 Feb. 12, 2009

Related U.S. Application Data

(63) Continuation of application No. 11/875,095, filed on Oct. 19, 2007, which is a continuation of application No. PCT/CN2006/000584, filed on Apr. 3, 2006.

(30) Foreign Application Priority Data

Apr. 19, 2005 (CN) ..... 2005 1 0034201

(51) Int. Cl.
*D01B 1/00* (2006.01)

(52) U.S. Cl. ..... 19/7

(58) Field of Classification Search ..... 19/5 R, 19/5 A, 7, 8, 10, 34
See application file for complete search history.

(56) References Cited

U.S. PATENT DOCUMENTS 1,729,772 A * 10/1929 Forsyth ..... 19/7
1,796,718 A * 3/1931 Nanji ..... 162/82
2,105,036 A * 1/1938 Freudenberg ..... 19/2
2,230,269 A * 2/1941 Pierce ..... 57/298
2,926,391 A * 3/1960 Haas ..... 19/7
3,020,189 A * 2/1962 Waggoner ..... 264/122
4,359,859 A * 11/1982 Bridgehouse et al. ..... 57/200
2008/0090078 A1 * 4/2008 Liu et al. ..... 428/401

FOREIGN PATENT DOCUMENTS

CN 1137071 A * 12/1996
CN 1511978 A * 7/2004
CN 1546751 A * 11/2004

* cited by examiner

*Primary Examiner*—Shaun R Hurley
(74) *Attorney, Agent, or Firm*—Matthias Scholl P.C.; Matthias Scholl

(57) ABSTRACT

Taught is a cotton stalk bark fiber. The fiber is a natural textile fiber made of cotton stalk balk. The length of the fiber is 5 mm-65 mm. The fineness thereof is 0.3-2.5 denier. The intensity thereof is 0.284-0.432 N/tex. The breaking elongation rate thereof is 3%-6%. Taught is further a method for processing cotton stalk bark fiber comprising peeling, skimming, degumming, preserving, cutting, tanning, opening, carding, baking, boxing and classifying, and packaging. The invention provides an inexpensive natural fiber having wide applications in the textile industry. The fiber has a similar performance to bast fiber, higher intensity than cotton fiber, and may be blended with other natural fiber, man-made fibers and recycled fiber to form fiber yarn for various purposes. This method changes waste into a commodity, and brings about economic and social benefits.

5 Claims, 1 Drawing Sheet

COTTON STALK BARK FIBER AND METHOD FOR PROCESSING COTTON STALK BARK

CROSS-REFERENCE TO RELATED APPLICATIONS

This application is a continuation of U.S. application Ser. No. 11/875,095 filed Oct. 19, 2007, now pending, which is a continuation of International PCT Patent Application No. PCT/CN2006/000584 with an international filing date of Apr. 03, 2006, designating the United States, now pending, and claims priority benefits to Chinese Patent Application No. 200510034201.4 filed Apr. 19, 2005. The contents of all of the aforementioned specifications, including any intervening amendments thereto, are incorporated herein by reference.

BACKGROUND OF THE INVENTION

1. Field of the Invention

The invention relates to a natural fiber, and more particularly to a cotton stalk bark fiber, as well as to a method for processing cotton stalk bark.

2. Description of the Related Art

Cotton is an important cash crop that has a wide planting area in China. Conventionally, only cotton seed fiber is utilized, and cotton stalk, accounting for a large part of the cotton, is discarded. In view thereof a natural textile fiber made of cotton stalk bark is desired, which features good textile performance and has great market prospects.

SUMMARY OF THE INVENTION

One objective of the invention is to provide cotton stalk bark fiber that is plentiful and inexpensive to produce, and has high economic benefit.

Another objective of the invention is to provide a method for processing cotton stalk bark fiber that features a feasible process route and a stable product quality.

In one aspect of the invention provided is a cotton stalk bark fiber, wherein the fiber is a natural textile fiber made of cotton stalk bark. The length of the fiber is 5 mm-65 mm. The linear mass density (fineness) thereof is 0.3-2.5 denier. The tenacity (intensity) thereof is 0.284-0.432 N/tex. The breaking elongation rate thereof is 3%-6%.

In other aspects the invention provides a method for processing cotton stalk bark fiber, comprising the steps of: peeling, skimming, degumming, preserving, cutting, tanning, opening, carding, baking, boxing and classifying, and packaging. Skimming is achieved using 20-60° C. acid warm water to immerse for 12-48 hours. Degumming is achieved using 20-60° C. alkaline warm water added with surfactant to immerse for 12-48 hours. Tanning processing is performed with tanning agent containing surfactant, plant oil, mineral oil and water.

The invention provides a natural fiber having a low price and wide applications for the textile industry. The fiber has similar performance to bast fiber, higher tenacity (intensity) than cotton fiber, and can be blended with other natural fibers, man-made fibers and recycled fibers to form fiber yam for various purposes. This method changes waste into a valuable commodity, and brings about great economic and social benefits.

BRIEF DESCRIPTION OF THE DRAWINGS

Detailed description will be given below in conjunction with accompanying drawing and embodiments, but will not constitute any limitation to the invention.

DETAILED DESCRIPTION OF THE INVENTION

Figure 1:
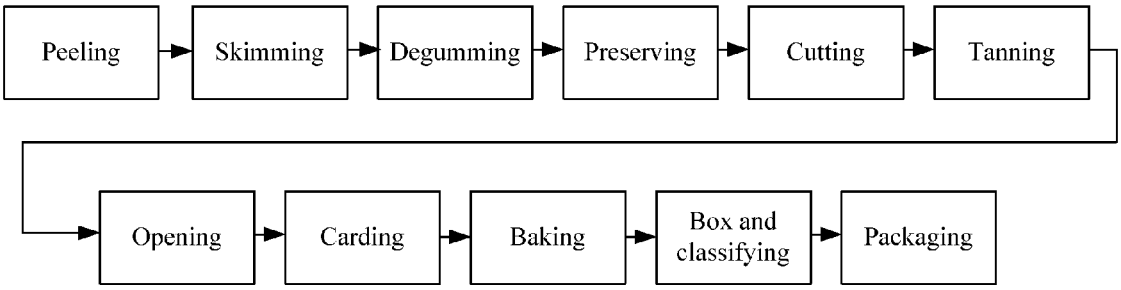
FIG. 1 is a process flow diagram of one embodiment of the invention.

As shown in FIG. 1, a process for processing cotton stalk bark to extract fiber comprises peeling, skimming, degumming, preserving, cutting, tanning, opening, carding, baking, boxing and classifying, and packaging. Detailed description of all these steps is as follows.

Peeling: The step of peeling comprises separating the cotton stalk bark from the cotton stalk manually/via a peeler.

Skimming: The step of skimming comprises immersing in 20-60° C. warm acid water for 12-48 hours. The acid used may be sulfuric acid and/or a metal sulfate, e.g., at a concentration of 1-10 g/L, so as to clear surface hard skin or lignin of the cotton stalk bark and obtain fasciculate long fiber.

Degumming: The step of degumming comprises immersing in 20-60° C. warm alkaline water with a surfactant for 12-48 hours, so as to isolate pectin component in the fasciculate long fiber. The alkali used may be sodium hydroxide , e.g., at a concentration of 3-12 g/L. The surfactant is selected from various commonly-used anions, cations and nonionic surfactants.

Preserving: The step of preserving comprises using a humid preservation method of emulsion, so as to improve moisture content, tenacity (intensity) and softness of the fiber.

Cutting: The step of cutting comprises cutting the fasciculate long fiber into fasciculate short fiber of a desired length manually/via cutting equipments as needed.

Tanning: The step of tanning comprises processing with a tanning agent comprising a surfactant, a plant oil, a mineral oil and water. The surfactant is selected from various common-used anions, cations and nonionic surfactant. Different types of surfactants are preferably employed simultaneously to improve the tanning result.

Opening: The step of opening comprises opening the fasciculate short fiber with a commonly-used fiber opener of prior art.

Carding: The step of carding comprises carding the opened fasciculate short fiber several times with a carding machine, so as to separate the material into cotton stalk bark fiber suitable for spinning.

Baking: The step of baking comprises baking the cotton stalk bark fiber.

Boxing and classifying: The step of classifying comprises classifying the cotton stalk bark fiber into various grades, e.g., with the help of an air classifier.

Packaging: The step of packaging comprises packaging the fiber into fiber packages of fixed weight according to fiber dimensions.

EXAMPLES

Example 1

In this example cotton stalk of dry medium cotton was used. Cotton stalk bark was manually separated from the stalk, paying attention so as to avoid introducing a hard lignified fiber layer from within the cotton stalk. The cotton stalk bark was immersed into a water pool having a sulfuric acid concentration of 10 g/L and a temperature of 60° C. for 12 hours, taken out and put into a water pool comprising 1% by weight of common laundry powder, and having a sodium hydroxide concentration of 12 g/L. The temperature was maintained at 60° C. for 12 hours. The obtained product was taken out and dried, then put into a humidifying bin. Silicon oil-water emulsion was uniformly sprayed thereon, and it was covered and preserved with a canvas for 18 hours. The preserved cotton stalk bark fiber was then cut into pieces of approximately 50 mm, and placed into a tanning agent solution comprising Lamepon A, JFC, peanut oil, engine oil and water for tanning. The tanned cotton stalk bark fiber was opened using a commonly-used fiber opener, and carded 3-5 times through a carding machine. The carded fiber was collected and placed in a dryer for drying. The cotton stalk bark fiber was finally separated into different dimensions using an air separator.

Example 2

In this example cotton stalk of dry medium cotton was used. Cotton stalk bark was manually separated from the stalk, paying attention so as to avoid introducing a hard lignified fiber layer from within the cotton stalk. The cotton stalk bark was immersed into a water pool with a sulfuric acid concentration of 1 g/L and a temperature of 20° C. for 48 hours, taken out and put into a water pool comprising 2% by weight of common laundry powder, and having a sodium hydroxide concentration of 3 g/L. The temperature was maintained at 20° C. for 48 hours. The obtained product was taken out and dried, then put into a humidifying bin. Silicon oil-water emulsion was uniformly sprayed thereon, and it was covered and preserved with a canvas for 24 hours. The preserved cotton stalk bark fiber was then cut into pieces of approximately 60 mm, and placed into a tanning agent solution comprising Lamepon A, JFC, peanut oil, engine oil and water for tanning. The tanned cotton stalk bark fiber was opened using a commonly-used fiber opener, carded 3-5 times through a carding machine. The carded fiber was collected and placed in a dryer for drying. The cotton stalk bark fiber was finally separated into different dimensions using an air separator.

Example 3

In this example cotton stalk of dry medium cotton was used. Cotton stalk bark was manually separated from the stalk, paying attention so as to avoid introducing a hard lignified fiber layer from within the cotton stalk. The cotton stalk bark was immersed into a water pool with a sulfuric acid concentration of 5 g/L and a temperature of 50° C. for 24 hours, taken out and put into a water pool comprising 1% by weight of common laundry powder, and having a sodium hydroxide concentration of 8 g/L. The temperature was maintained at 50° C. for 24 hours. The obtained product was taken out and dried, then put into a humidifying bin. Silicon oil-water emulsion was uniformly sprayed thereon, and it was covered and preserved with a canvas for 24 hours. The preserved cotton stalk bark fiber was then cut into pieces of approximately 50 mm, and placed into a tanning agent solution comprising Lamepon A, JFC, peanut oil, engine oil and water for tanning. The tanned cotton stalk bark fiber was opened using a commonly-used fiber opener, carded 3-5 times through a carding machine. The carded fiber was collected and placed in a dryer for drying. The cotton stalk bark fiber was finally separated into different dimensions using an air separator.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

What is claimed is:

1. A method for preparing a cotton stalk bark fiber comprising the steps of:

(a) separating cotton stalk bark from the cotton stalk manually or with a mechanical peeler; followed by (b) immersing product obtained in step (a) in 20-60° C. warm acid water for 12-48 hours; followed by (c) immersing product obtained in step (b) in 20-60° C. warm alkaline water with a surfactant for 12-48 hours; followed by (d) immersing product obtained in step (c) in a preserving emulsion; followed by (e) cutting material obtained in step (d); followed by (f) processing material obtained in step (e) with a tanning agent comprising a surfactant, a plant oil, a mineral oil and water; followed by (g) opening fasciculate short fiber obtained in step (f) with a fiber opener; followed by (h) carding; followed by (i) baking.

2. The method of claim 1, wherein said acid water in step (b) comprises sulfuric acid or a metal sulfate.

3. The method of claim 2, wherein said sulfuric acid or said metal sulfate is provided at a concentration of between 1 and 10 g/L.

4. The method of claim 1, wherein said alkaline water in step (c) comprises sodium hydroxide.

5. The method of claim 4, wherein said sodium hydroxide is provided at a concentration of between 3 and 12 g/L.

* * * * *